United States Patent [19]

Riecker et al.

[11] 4,198,275

[45] Apr. 15, 1980

[54] EQUIPMENT FOR EXTRACTING AND PURIFYING DIRTY GASES ARISING ON THE COKE SIDE OF A BATTERY OF CHAMBER COKE OVENS WITH VERTICAL FLUES

[75] Inventors: Johann G. Riecker, Ratingen; Klaus Grohmann, Kaarst, both of Fed. Rep. of Germany

[73] Assignee: Hartung, Kuhn & Co. Maschinenfabrik GmbH, Dusseldorf, Fed. Rep. of Germany

[21] Appl. No.: 845,869

[22] Filed: Oct. 27, 1977

[51] Int. Cl.[2] ..... C10B 33/00; C10B 39/14

[52] U.S. Cl. ..... 202/263

[58] Field of Search ..... 202/262, 263, 227, 230

[56] References Cited

U.S. PATENT DOCUMENTS

| | | | |
|---|---|---|---|
| 3,729,384 | 4/1973 | Kinzler et al. | 202/263 |
| 3,746,626 | 7/1973 | Morrison, Jr. | 202/263 |
| 3,970,526 | 7/1976 | Bender et al. | 202/227 |
| 3,984,289 | 10/1976 | Sustarsic et al. | 202/263 X |
| 4,039,394 | 8/1977 | Friend | 202/263 X |
| 4,069,108 | 1/1978 | Riecker | 202/263 |

*Primary Examiner*—Arnold Turk
*Attorney, Agent, or Firm*—Dressler, Goldsmith, Clement, Gordon & Shore, Ltd.

[57] ABSTRACT

A locomotive is provided to move a quench car and a gas transition car parallel to a battery of coke ovens adjacent a coke guide car. A pivotable hood is provided on the guide car for covering part of the charging opening of the quench car. The quench car has generally parallel, pivotal flaps which can operate independently to open a portion of the quench car charge opening beneath the hood as coke is pushed from the guide and through the hood into the car. The flaps on either side of the hood can be held closed to seal the charge opening and prevent escape of the dirty gases out of the quench car. An extraction duct connects the quench car to the gas transition car cooperably connected with a gas collection duct which also runs parallel to the coke ovens and which has an opening running its length. The opening is sealed by a belt, a portion of which is lifted away from sealing engagement with the collection duct by the gas transition car to allow passage of gases into the collection duct and then to gas extraction and purifying equipment.

12 Claims, 14 Drawing Figures

Fig. 10.
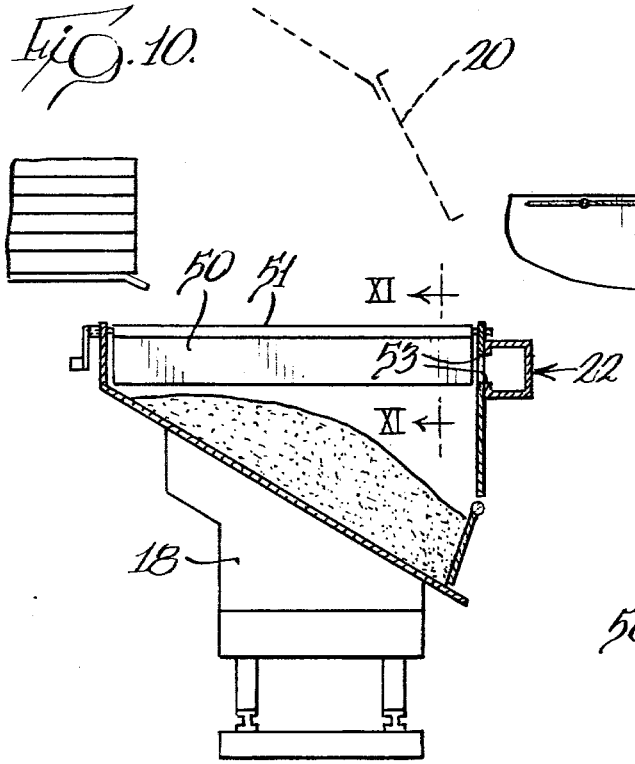
Fig. 11.
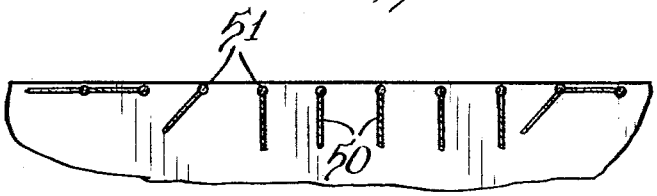
Fig. 12.
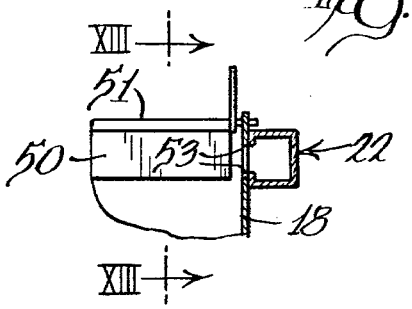
Fig. 13.
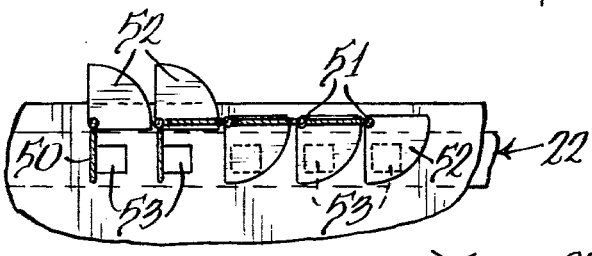
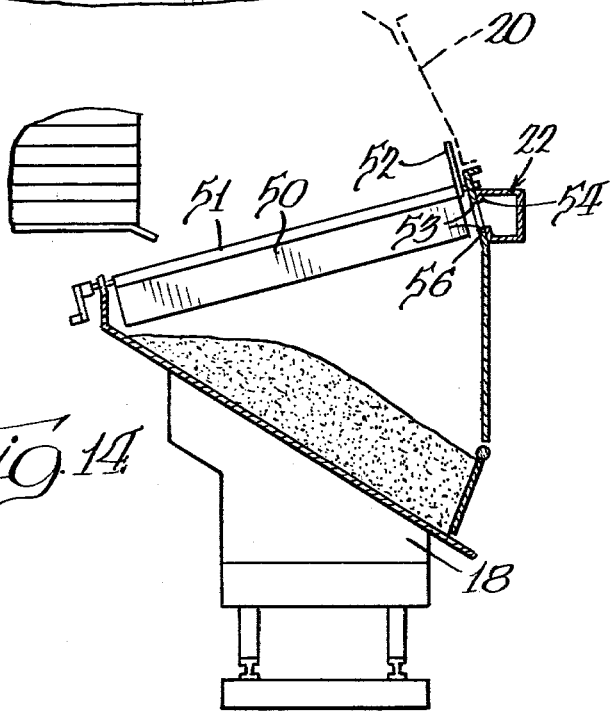
Fig. 14.

EQUIPMENT FOR EXTRACTING AND PURIFYING DIRTY GASES ARISING ON THE COKE SIDE OF A BATTERY OF CHAMBER COKE OVENS WITH VERTICAL FLUES

BACKGROUND OF THE INVENTION

The invention relates to equipment for extracting and purifying dirty gases originating from red-hot coke batches which are pushed out of the oven chambers of a battery of chamber coke ovens with vertical flues into a quench container, transported to a quenching plant, quenched there and subsequently discharged on a coke ramp. Such equipment comprises a coke guide car which is movable on a track in front of the oven chambers and parallel to the longitudinal axis of the battery and a quench train which is movable on a track underneath the coke guide car and on the side of the latter facing away from the battery and parallel thereto. The train comprises a quench container car and a quench locomotive with the coke guide car being connected to an extraction hood which reaches over the full width of the quench container. The quench container defines an upper charge opening which can be closed. The quench container can be permanently connected via an extraction duct to a device for extracting and purifying the dirty gases.

Installations are known in which, when coke is pushed out, the extraction of the dirty gases is effected by devices which draw the emissions against, away from, or out of, the normal thermal convective flow, through a quench car, and then to a mobile wash unit. The extraction of emissions out of the normal thermal buoyancy flows (rising convective hot gas flows) yields poor results in all those cases in which the extraction capacity is limited. This applies particularly in the case of mobile units. These units cannot exceed certain predetermined weights and dimensions and, due to their inadequate extraction capability, do not completely eliminate emissions during the pushing process. (See for example U.S. Pat. No. 3,984,289 (Sustarsic et al.), U.S. Pat. No. 3,843,461 (J. E. Allen), and U.S. Pat. No. 3,868,309 [Sustarsic et al.]).

By contrast, it is the object of the present invention to modify a quench car, which can be covered in such a way that even if the dirty gases are extracted out of the normal, convection thermal buoyancy flows, an adequate degree of collection is ensured.

SUMMARY OF THE INVENTION

According to the invention, this is achieved when the covered quench car is continusouly connected to a stationary extraction duct, through which quantities of gas can be extracted which suffice to ensure that the process is free from emissions. According to the invention, the quench car or quench train is connected to a gas transition car which in turn is located on the quench car tracks behind or in front of the quench train. In this case, the space below or between the quench car tracks is laid out as a stationary gas collection duct. This is a possibility particularly when new coke oven batteries are constructed since, in this way, the necessity for special support structures on the ramp side is eliminated. According to a further embodiment, the gas transition car can also be movable on an extraction duct running above the coke ramp.

A regenerator, to protect any flexible cover belt that may be used, can either be arranged along the locomotive in the course of the extraction pipe duct or it can be coupled to the locomotive as a separate gas cooling car. Additionally, protective devices which eliminate the need for a regenerator can also be provided within the stationary gas channel.

In order to ensure that the gases rising in the zone of the coke guide are collected, it is proposed in accordance with the invention, to install on the coke guide a hot gas fan for extracting these emissions. The fan flow can be directed and discharged into the hood in such a way that it counteracts the buoyancy of the gases through an entrainment effect.

BRIEF DESCRIPTION OF THE DRAWINGS

With the aid of several illustrative embodiments, the invention will be explained with reference to the following simplified diagram figures and in which:

FIG. 10 shows a partial cross section of a third embodiment of the invention;

FIG. 11 shows a partial cross section of the third embodiment along the line XI—XI in FIG. 10;

FIG. 12 is a partial view similar to FIG. 10 showing more detail and a moved position of some flaps in phantom;

FIG. 13 is a partial view taken along the line XIII—XIII of FIG. 12 showing in more detail the end flaps and segments in various positions; and FIG. 14 is a partial cross-sectional view of a fourth embodiment of the invention similar to FIG. 10.

DESCRIPTION OF THE PREFERRED EMBODIMENTS

Figure 1:
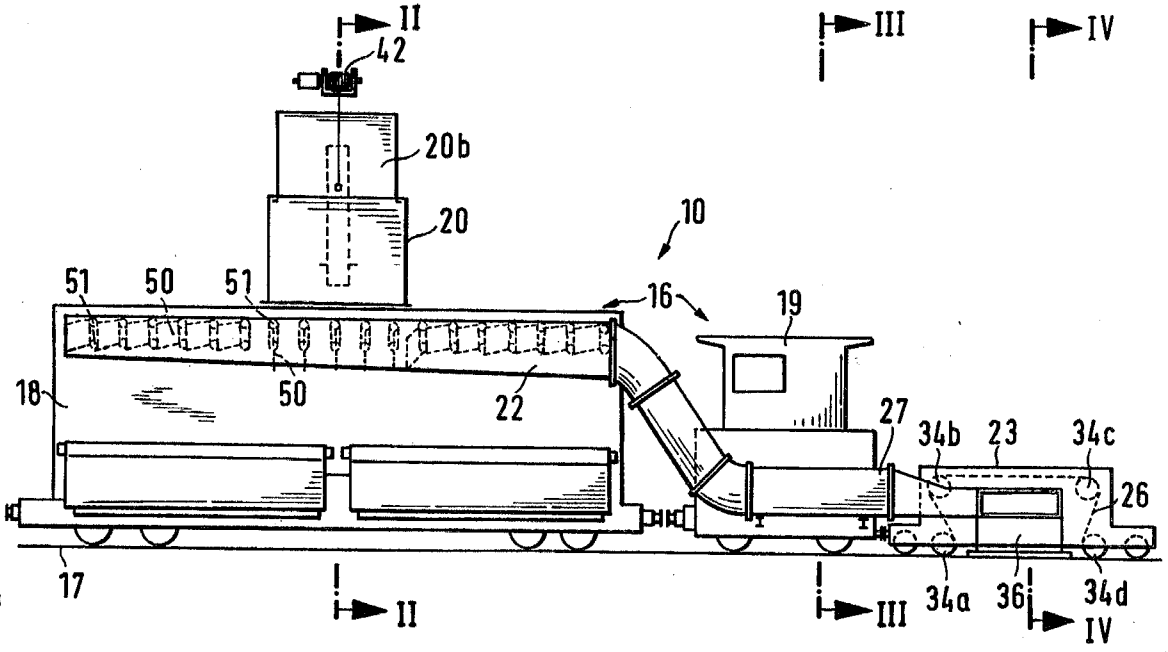
FIG. 1 shows a side view of an embodiment of the equipment according to the invention.
Figure 2:
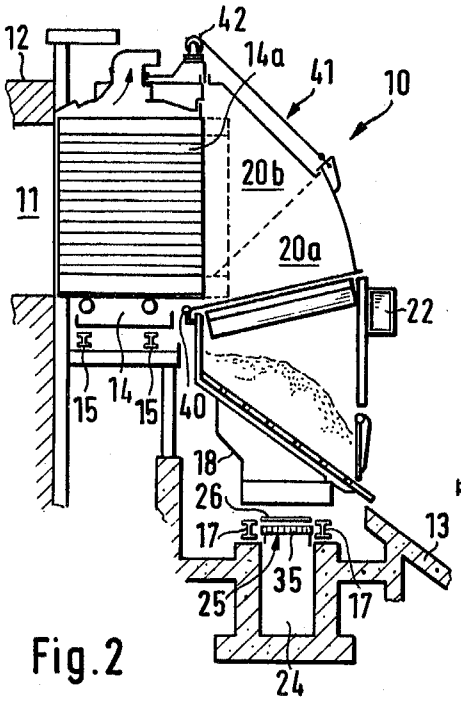
FIG. 2 shows a cross section through the equipment in FIG. 1, along the line II—II in FIG. 1.

The FIGS. 1 and 2 show equipment, generally designated as 10, for extracting and purifying dirty gases originating from red-hot coke batches which are pushed out of one particular oven chamber 11 of a battery 12 of chamber coke ovens with vertical flues into a quench container, which are transported to a quenching plant which is not shown, and which are quenched there and subsequently discharged into a coke ramp 13. In detail, the equipment consists of a coke guide car 14 which is movable on a track 15 in front of the oven chambers 11 and parallel to the longitudinal axis of the battery 12, and of a quench train (generally designated as 16) which is movable on a track 17 beneath the coke guide car 14 and on the side of the car 14 facing away from the battery. The train 16 comprises a quench container car 18 and a quench locomotive 19. An extraction hood 20 is connected to the coke guide car 14 and reaches over the full width of the quench container car 18. As will be described in more detail below, the upper charge opening 21 of the quench container car can be closed, the quench container being permanently connected via an extraction duct 22 to a device for extracting and purifying the dirty gases (not shown). The quench container 18 and duct 22 may have coincident apertures (not shown) to allow the passage of gas from the car to the duct.

Figure 4:
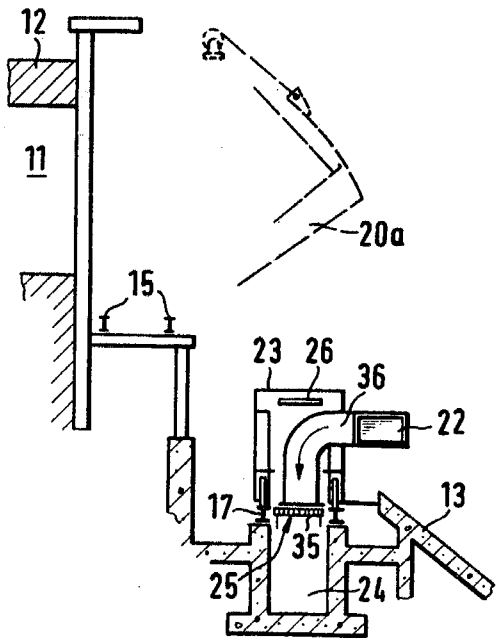
FIG. 4 shows a cross section along the line IV—IV in FIG. 1.
Figure 3:
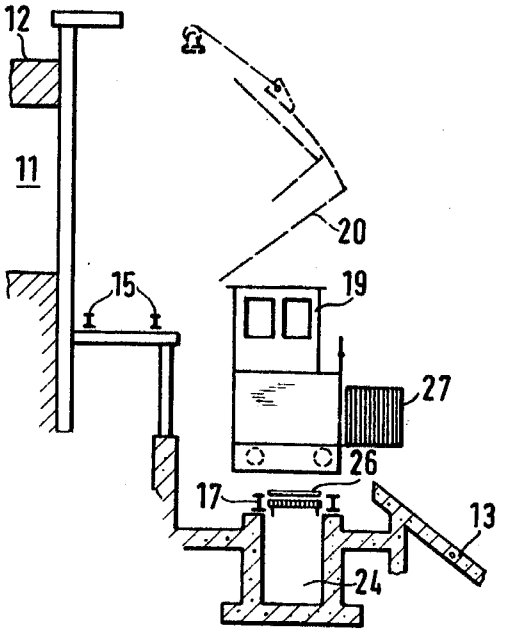
FIG. 3 shows a cross section along the line III—III in FIG. 1.

According to the invention and as illustrated in FIGS. 3 and 4, the extraction duct 22 of the quench container is connected to a gas transition car 23 which is movable on a stationary gas collection duct 24 which is laid out parallel to the battery and has a passage opening 25 (FIG. 2) in the top and extending along the gas collection duct and can be sealed by a flexible cover belt 26. This flexible cover belt 26, preferably consisting of heat-resisting material, can for a particular part of its length, by means of the gas transition car 23, be lifted off the gas collection duct which is connected to the stationary extraction and purifying device (not shown).

According to the embodiment illustrated in FIGS. 1 to 4, the gas transition car 23 is movable on the quench car track 17 and the gas collection duct extends below the quench car track parallel to the longitudinal direction thereof. The gas transition car 23 is freely movable and is coupled to the quench locomotive 19 at the end facing away from the quench container car 18.

A gas cooler 27 is inserted into the extraction duct 22 of the quench container car 18 and is mounted on the quench locomotive 19 on the side facing away from the battery 12.

Figure 7:
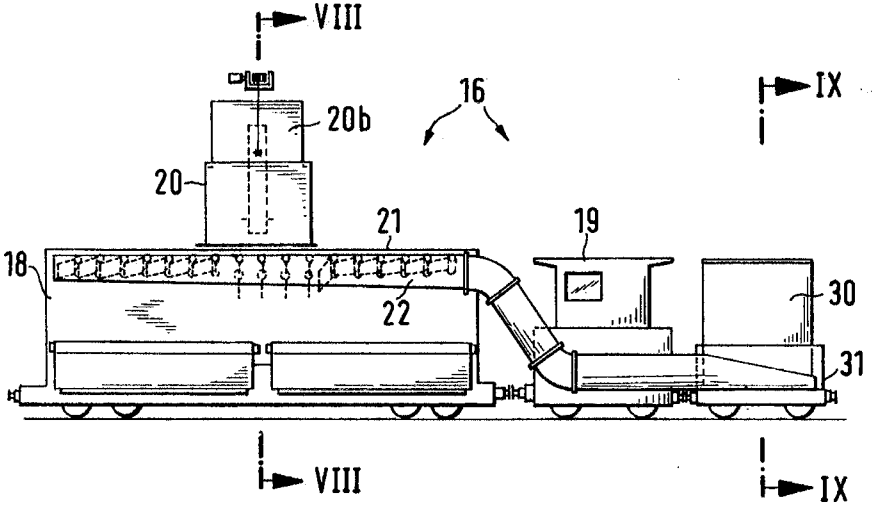
FIG. 7 shows a side view of a second embodiment of equipment according to the invention.
Figure 8:
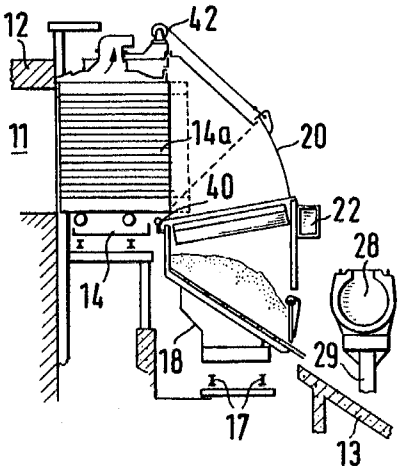
FIG. 8 shows a cross section of the second embodiment along the line VIII—VIII in FIG. 7.
Figure 9:
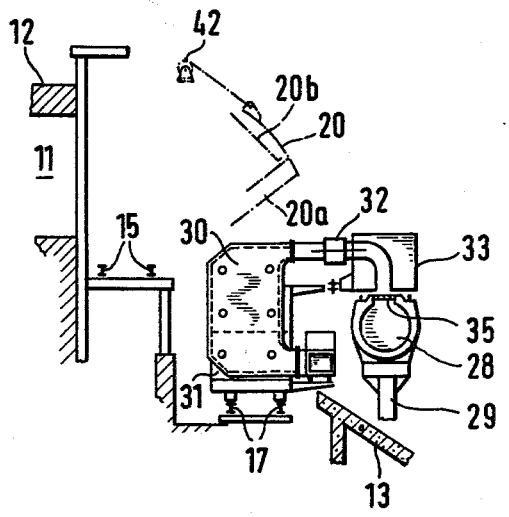
FIG. 9 shows a cross section along the line IX—IX in FIG. 7.

In the second embodiment shown in FIGS. 7 to 9, a gas collection duct 28 is located on supports 29 on the side of the quench car track 17 facing away from the battery 12 and parallel thereto. A gas cooler 30 is mounted on a tender 31, which is coupled to the quench locomotive 19, is movable on the quench car track 17 and is connected via a flexible coupling 32 to a gas transition car 33 which again is freely movable on the top of the gas collection duct 28 by means of the quench train.

With either of the first or second embodiments of the invention described above, the gas collections (24 for the first embodiment and 28 for the second embodiment) are sealingly engaged with the gas transition car (23 and 33 for the first and second embodiments, respectively) to allow travel of the car with the locomotive. Specifically, as can be seen from FIGS. 1 and 2, the flexible cover belt 26 is lifted off, in a known manner, via guide rollers 34*a*, 34*b*, 34*c* and 34*d* from a grate 35 which covers the longitudinally extending upper opening of the gas collection ducts 24 or 28 and which serves as support for the flexible belt and makes it possible to walk on the gas collection duct.

With reference to the first embodiment, the gas transition car has a lateral opening 36 (FIG. 1) which is tightly connected to the extraction duct 22 so that there is a gastight gas-side connection between the interior of the quench container car and the gas collection duct connected to the stationary extracting and purifying device.

The hood 20 which reaches over the quench container car 18 is constructed in a known manner in several parts: lower part 20*a* and upper part 20*b*. Lower part 20*a*, overhanging the quench container car, is telescopically pivotable, relative to the part 20*b* of the hood which lies above and is rigidly joined to the coke guide car 14, by means of a pivoting device 41 about a horizontal axis 40 aligned parallel to the longitudinal direction of the battery. The pivoting device 41 consists of a rope tackle block 42 which is mounted on the top of the coke guide 14*a* of the coke guide car 14 and can, for example, consist of a motor-driven rope winch 42 (not shown in more detail).

Figure 6:
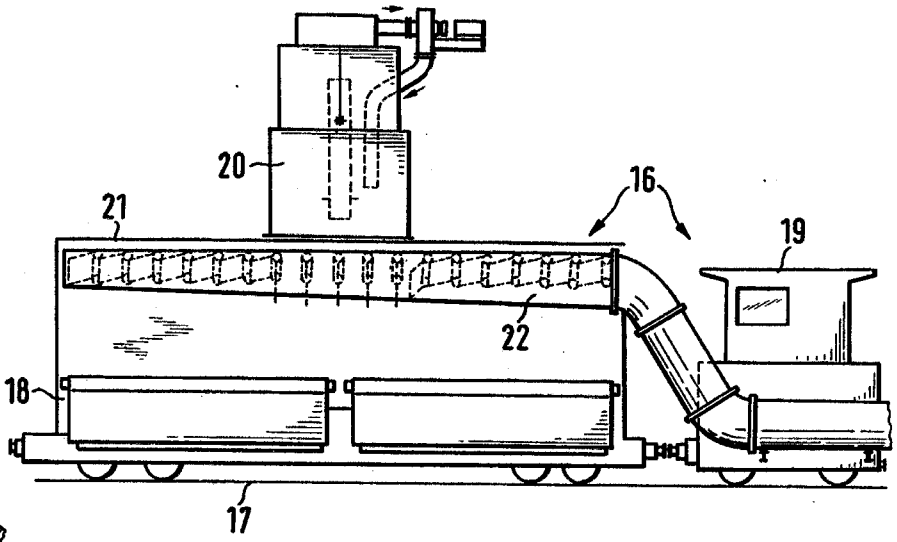
FIG. 6 shows a side view of the modification illustrated in FIG. 5 and similar to FIG. 1.
Figure 5:
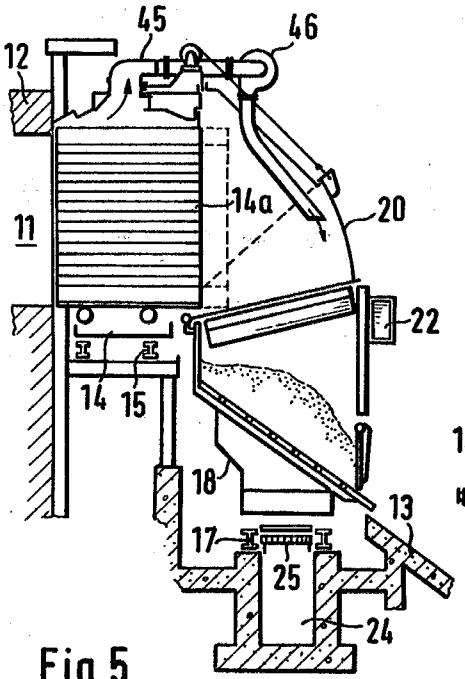
FIG. 5 shows a view of a modification of the first embodiment of the invention, similar to that of FIG. 2, but with an extraction duct, leading into an extraction hood, of the coke guide.

In a modification of the first embodiment illustrated in FIG. 2, FIGS. 5 and 6 show the top of the coke guide 14*a* connected to a duct 45 which leads into the extraction hood 20 and into which an extraction fan 46 is installed. The fan 46 is located outside the extraction hood 20 and the duct 45 runs from the fan 46 into the interior of the hood 20 where it discharges. This part of the duct forms a delivery branch which, due to its injector or jet pump type of entrainment effect, can counteract the buoyancy, rising, convection flow of the gases within the extraction hood 20.

The top of the quench container car 18 can be closed by flaps 50 which are pivotable about axles 51. The axles are spaced apart and parallel in one plane sloping upwardly at an angle, for example, 30°, in the direction of the extraction duct 22. The flaps 50 can thus be arranged in a mutually overlapping closed position and in a parallel vertical open position spaced from one another, as shown in FIGS. 1 and 7. It can be seen in FIGS. 1 and 7 that the flaps 50 below the hood 20 are in their vertical, open position, while the flaps 50 outside of the hood (on either side) assume the closed position. This demonstrates that the flaps can be moved independently of one another into their open and closed positions. This is particularly advantageous when the quench container car is moved under the hood while the red-hot coke is pushed out of an oven chamber 11, in order to distribute the red-hot coke uniformly over the loading area of the quench container car. The flaps 50 can here be controlled and pivoted with the axles by suitable mechanisms (not shown) in such a way that at the particular time only the flaps under the hood 20 assume the open position so that dust-containing gases cannot escape into the atmosphere. Since the cover of the quench container car, formed by the flaps 50, slopes upwards to the extraction duct 22, the dirty gases rising from the red-hot coke are, due to the thermal buoyancy, deflected in the direction of the extraction duct 22 and this assists the disposal of the gases.

In the third embodiment of the present invention, a flat-topped container 18 is provided with the modified flaps 50 as illustrated in FIGS. 10 through 13. Specifically, the duct 22 and container 18 have coincident, square-shaped apertures 53 which allow the gases to pass from the container into the duct. The flaps 50 have baffle or closure segments 52 at one end adjacent the apertures 53 for reducing flow through the apertures 53 when the flaps 50 are closing the top (charge opening 21) of the container 18. When the flaps 50 are aligned vertically to "open" the top of the container 18, then the closure segments 52 are rotated away from the apertures 53 (FIG. 13) and allow the gases to flow from the hood 20 and the container 18 into the duct 22.

This novel design has the advantage that, at any given position, since only those flaps beneath the hood are opened, only those apertures 53 beneath the hood are fully opened. Thus, the vacuum or suction force of the fans used to pull the extraction flow from the container 18 into the duct 22 is thus concentrated to those few "open" apertures 53 at any particular point of travel of the container car under the hood 20 while applying sufficient reduced suction at those partly closed apertures 53 corresponding to closed flaps 50 to cope with the lower emission rate of coke already pushed or during travel to the quench station. FIG. 11 shows, schematically, the orientation of the flaps 50 along the container car 18 when the hood 20 is intermediate of the ends of the car so that the flaps on each end are "closed." FIG. 13 shows some of the end segments 52 (having the shape of a quarter circle) reducing the apertures 53 and some of the segments 52 moved away from the apertures 53 to "open" them.

FIG. 14 illustrates a container car 18 having an upwardly slanted top with upwardly slanting flaps 50 with segments 52 at right angles thereto. The wall 56 of the container 18 and the wall 54 of the duct 22 are slanted to form a right angle with respect to the container top and the flap axles 51 so that the segments 52 can be parallel to wall 54 when the segments are rotated to "reduce" apertures 53 and so that segments 52 can thus more effectively apply suction in the area of falling coke where by far the largest portion of emissions is generated.

The pivotability of the extraction hood 20 enables the hood to be matched exactly to the dimensions of the quench container car, irrespective of the height of the quench locomotive, since it is possible in this way that the quench locomotive, even if its constructed height is greater than that of the quench container car, can move past under the hood when the hood is in the raised position.

It will be understood that, as a result of the invention, there are virtually no limits to the extraction capacity to be installed, due to the permanent connection of the quench container car to the gas collection duct and to the stationary extracting and purifying device linked thereto. Thus, it is possible to ensure with absolute certainty that, right from the start and during the movement of the quench container car to a quenching plant, the contaminated gases rising from the red-hot coke in the closed quench container, as well as the subsequently generated quench vapors during the movement of the quenched coke to the coke ramp, can be completely extracted and purified so that any pollution of the surroundings of the coke oven battery on the coke sie is prevented with certainty.

We claim:

1. Equipment for extracting and purifying dirty gases originating from red-hot coke batches which are pushed into a quench container car from the oven chambers of a battery of coke oven chambers with vertical heating flues, transported to a quenching plant, quenched there and subsequently discharged onto a coke ramp, said equipment comprising:

a coke guide car and a first track in front of the oven chambers and parallel to the longitudinal axis of the battery, said guide car being movable on said first track;

a second track below and parallel to the coke guide car and located on the side of the guide car facing away from the battery; said second track including two spaced-apart parallel rails a quench train movable on said second track and including said quench container car and a quench locomotive for moving said quench container car along said guide car and said oven chambers, said quench container car having an upper charge opening and a means for closing said charge opening, said coke guide car having a connected extraction hood with an open bottom and adapted to extend over the full width of said quench container car above said upper charge opening;

a device for extracting and purifying dirty gases;

a stationary gas collection duct parallel to said battery and communicating with said extracting and purifying device, said collection duct defining in the upper part thereof an opening; said gas collection duct being disposed below said second track parallel to the longitudinal direction thereof with its opening oriented between said two rails;

a flexible cover belt means for sealing said collection duct opening;

a gas transition car adjacent to, and freely movable along, said stationary gas collection duct; said gas transition car having means for being moved on said second track;

means associated with said gas transition car for lifting a portion of the length of said belt means off of said gas collection duct away from said opening; and an extraction duct connecting said quench container car and said gas transition car whereby said dirty gases pass from the opening at the bottom of said extraction hood to said quench container car and in sequence through said extraction duct, gas transition car, and collection duct to said extracting and purifying device as said quench car and gas transition car are moved along said battery of ovens.

2. The equipment in accordance with claim 1 in which said freely movable gas transition car is coupled to the quench train.

3. The equipment in accordance with claim 1 in which said gas transition car is coupled to said quench locomotive at the end facing away from the quench container car.

4. The equipment in accordance with claim 1 further including a gas cooler inserted in said extraction duct ahead of the connection to said gas transition car.

5. The equipment in accordance with claim 4 further including (1) a tender coupled to said quench locomotive and movable on said second track, said cooler being mounted on said tender, and (2) a flexible coupling connecting said gas cooler and said gas transition car.

6. The equipment in accordance with claim 1 in which said quench container car further has, in the upper charge opening, an array of spaced, mutually parallel pivotable axles and flaps mounted thereon, said axles being arranged in a plane sloping upwardly toward said extraction duct, whereby said flaps can be rotated with said axles into a mutually overlapping closed position and into an open position in which the flaps are parallel, vertical and spaced from one another.

7. The equipment in accordance with claim 6 in which said flaps are movable independently of one another into their open and closed positions.

8. Equipment for extracting and purifying dirty gases originating from red-hot coke batches which are pushed into a quench container car from the oven chambers of a battery of coke oven chambers with vertical heating flues, transported to a quenching plant, quenched there and subsequently discharged onto a coke ramp, said equipment comprising:

a coke guide car and a first track in front of the oven chambers and parallel to the longitudinal axis of the battery, said guide car being movable on said first track;

a second track below and parallel to the coke guide car and located on the side of the guide car facing away from the battery;

a quench train movable on said second track and including said quench container car and a quench locomotive for moving said quench container car along said guide car and said oven chambers, said quench container car having an upper charge opening and a means for closing said charge opening, said coke guide car having a connected extraction hood with an open bottom and adapted to extend over the full width of said quench container car above said upper charge opening;

a coke guide carried on said guide car and a coke guide duct connected to the top of the coke guide and leading into said extraction hood and having a discharge opening located below the top of said coke guide, said coke guide duct having an extraction fan to draw gases from the top of said coke guide into said hood;

a device for extracting and purifying dirty gases;

a stationary gas collection duct parallel to said battery and communicating with said extracting and purifying device, said collection duct defining in the upper part thereof an opening;

a flexible cover belt means for sealing said collection duct opening;

a gas transition car adjacent to, and freely movable along, said stationary gas collection duct;

means associated with said gas transition car for lifting a portion of the length of said belt means off of said gas collection duct away from said opening; and an extraction duct connecting said quench container car and said gas transition car whereby said dirty gases pass from the opening at the bottom of said extraction hood to said quench container car and in sequence through said extraction duct, gas transition car, and collection duct to said extracting and purifying device as said quench car and gas transition car are moved along said battery of ovens.

9. The equipment in accordance with claim 1 further including supports on the side of said second track facing away from the battery of coke ovens and parallel thereto for supporting said gas collection duct thereon.

10. Equipment for extracting and purifying dirty gases originating from red-hot coke batches which are pushed into a quench container car from the oven chambers of a battery of coke oven chambers with vertical heating flues, transported to a quenching plant, quenched there and subsequently discharged onto a coke ramp, said equipment comprising:

a coke guide car and a first track in front of the oven chambers and parallel to the longitudinal axis of the battery, said guide car being movable on said first track;

a second track below and parallel to the coke guide car and located on the side of the guide car facing away from the battery;

a quench train movable on said second track and including said quench container car and a quench locomotive, said coke guide car having a connected extraction hood adapted to reach over the full width of said quench container car, said quench container car having an upper charge opening and a means for closing said charge opening;

a device for extracting and purifying dirty gases;

a stationary gas collection duct parallel to said battery and communicating with said extracting and purifying device, said collection duct defining in the upper part thereof an opening;

a flexible cover belt means for sealing said collection duct opening;

a gas transition car adjacent to, and freely movable along, said stationary gas collection duct;

means associated with said gas transition car for lifting a portion of the length of said belt means off of said gas collection duct away from said opening; and an extraction duct connecting said quench container car and said gas transition car whereby said dirty gases pass from said quench container car in sequence through said extraction duct, gas transition car, and collection duct to said extracting and purifying device as said quench car and gas transition car are moved along said battery of ovens; said extraction duct and said container car having coincident apertures allowing flow of gases from said car to said extraction duct; said quench container car further having, in the upper charge opening, an array of spaced, mutually parallel and independently pivotable axles and flaps mounted thereon with each said flap having an associated aperture, said axles being arranged in a plane sloping upwardly toward said extraction duct, whereby said flaps can be rotated with said axles independently of one another into a mutually overlapping closed position and into an open position in which the flaps are parallel, vertical and spaced from one another; each of said flaps having an aperture closure segment mounted on one end for reducing flow from said car through its associated aperture when the flap is in the closed position in the opening of the container car.

11. The equipment in accordance with claim 10 in which said container car has a sidewall and said extraction duct has at least one wall parallel to, and in face-to-face contact with said sidewall of said container, each of said walls defining said coincident apertures therein, and in which said segments are parallel to said walls.

12. Equipment for extracting and purifying dirty gases originating from red-hot coke batches which are pushed into a quench container car from the oven chambers of a battery of coke oven chambers with vertical heating flues, transported to a quenching plant, quenched there and subsequently discharged onto a coke ramp, said equipment comprising:

a coke guide car and a first track in front of the oven chambers and parallel to the longitudinal axis of the battery, said guide car being movable on said first track;

a second track below and parallel to the coke guide car and located on the side of the guide car facing away from the battery;

a quench train movable on said second track and including said quench container car and a quench locomotive, said coke guide car having a connected extraction hood adapted to reach over the full width of said quench container car, said quench container car having an upper charge opening and a means for closing said charge opening;

a device for extracting and purifying dirty gases;

a stationary gas collection duct parallel to said battery and communicating with said extracting and purifying device, said collection duct defining in the upper part thereof an opening;

a flexible cover belt means for sealing said collection duct opening;

a gas transition car adjacent to, and freely movable along, said stationary gas collection duct;

means associated with said gas transition car for lifting a portion of the length of said belt means off of said gas collection duct away from said opening; and an extraction duct connecting said quench container car and said gas transition car whereby said dirty gases pass from said quench container car in sequence through said extraction duct, gas transition car, and collection duct to said extracting and purifying device as said quench car and gas transition car are moved along said battery of ovens; said container car and said extraction duct defining pairs of coincident apertures allowing flow of gases from said container car to said extraction duct, said container car further having at the upper charge opening, an array of spaced, mutually parallel pivotable axles and flaps mounted on said axles, said axles being arranged in a plane across the top of the container, each of said flaps having an aperture closure segment mounted on one end for reducing flow from said car through one pair of said coincident apertures when the flap is in the closed position in the opening of the container car.

* * * * *